US010458204B2

(12) United States Patent
Churchill

(10) Patent No.: US 10,458,204 B2
(45) Date of Patent: Oct. 29, 2019

(54) DOWNHOLE TOOL

(71) Applicant: Churchill Drilling Tools Limited, Aberdeen (GB)

(72) Inventor: Andrew Philip Churchill, Aberdeen (GB)

(73) Assignee: Churchill Drilling Tools Limited, Aberdeen (GB)

( * ) Notice: Subject to any disclaimer, the term of this patent is extended or adjusted under 35 U.S.C. 154(b) by 401 days.

(21) Appl. No.: 15/304,349

(22) PCT Filed: Apr. 17, 2015

(86) PCT No.: PCT/GB2015/051161
§ 371 (c)(1),
(2) Date: Oct. 14, 2016

(87) PCT Pub. No.: WO2015/159095
PCT Pub. Date: Oct. 22, 2015

(65) Prior Publication Data

US 2017/0037707 A1 Feb. 9, 2017

(30) Foreign Application Priority Data

Apr. 17, 2014 (GB) ..... 1406959.5
Oct. 30, 2014 (GB) ..... 1419368.4

(51) Int. Cl.
*E21B 29/00* (2006.01)
*E21B 37/00* (2006.01)
(Continued)

(52) U.S. Cl.
CPC ..... *E21B 37/00* (2013.01); *E21B 23/08* (2013.01); *E21B 29/00* (2013.01); *E21B 33/138* (2013.01);
(Continued)

(58) Field of Classification Search
CPC ..... E21B 17/1078; E21B 23/08; E21B 29/00; E21B 33/138; E21B 37/00; E21B 41/0078; E21B 43/08; E21B 43/114
See application file for complete search history.

(56) References Cited

U.S. PATENT DOCUMENTS 2,586,015 A 2/1952 Edwards
3,254,720 A 6/1966 Huitt et al.
(Continued)

FOREIGN PATENT DOCUMENTS

WO 02032634 A3 8/2002
WO 2015126258 A1 8/2015

OTHER PUBLICATIONS

International Search report—written opinion, PCT/GB2015/051161,9 pages, dated Oct. 14, 2015.
(Continued)

*Primary Examiner* — Daniel P Stephenson
(74) *Attorney, Agent, or Firm* — Dinsmore & Shohl LLP

(57) ABSTRACT

A downhole tool comprises a body having a fluid inlet and a fluid outlet and configured to accelerate fluid flowing along a fluid flow path from the inlet to the outlet. The fluid outlet is configured to provide a radially directed and substantially circumferentially continuous stream of fluid. The stream of fluid may be used to clean or cut downhole tubing, such as casing.

51 Claims, 9 Drawing Sheets

(51) Int. Cl.

| | |
|---|---|
| ***E21B 43/114*** | (2006.01) |
| ***E21B 23/08*** | (2006.01) |
| ***E21B 33/138*** | (2006.01) |
| ***E21B 41/00*** | (2006.01) |
| *E21B 17/10* | (2006.01) |
| *E21B 43/08* | (2006.01) |

(52) U.S. Cl.

CPC ..... *E21B 41/0078* (2013.01); *E21B 43/114* (2013.01); *E21B 17/1078* (2013.01); *E21B 43/08* (2013.01)

(56) References Cited

U.S. PATENT DOCUMENTS 3,547,191 A * 12/1970 Malott ..... E21B 7/18 166/223
4,278,127 A 7/1981 Rankin et al.
5,445,220 A * 8/1995 Gurevich ..... B24C 1/045 166/223
5,839,511 A * 11/1998 Williams ..... E21B 37/00 166/312
6,325,305 B1 * 12/2001 Kuhlman ..... E21B 37/00 166/222
9,416,636 B2 * 8/2016 Myhre ..... E21B 29/06
9,677,364 B2 * 6/2017 Tallini ..... E21B 29/02
10,119,349 B2 * 11/2018 Umphries ..... E21B 29/00
2003/0051870 A1 * 3/2003 Robertson ..... E21B 29/02 166/55
2004/0089450 A1 * 5/2004 Slade ..... B24C 1/045 166/298
2010/0218952 A1 9/2010 Robertson
2011/0061864 A1 3/2011 Umphries et al.
2011/0220357 A1 * 9/2011 Segura ..... E21B 29/002 166/298
2011/0284224 A1 11/2011 Misselbrook et al.
2012/0018158 A1 1/2012 Misselbrook et al.
2013/0192830 A1 8/2013 Watson et al.
2014/0034315 A1 * 2/2014 Tallini ..... E21B 29/02 166/297
2017/0030156 A1 2/2017 Churchill
2017/0037707 A1 * 2/2017 Churchill ..... E21B 29/00

OTHER PUBLICATIONS

Search Report dated Oct. 29, 2014, 5 pages, Application No. GB1406959.5.
Search Report dated Jan. 27, 2015 , 3 pages, Application No. GB1406959.5.
Office Action in corresponding U.S. Appl. No. 15/304,374 citing reference; 11 pages.

* cited by examiner

DOWNHOLE TOOL

CROSS-REFERENCE TO RELATED APPLICATIONS

This application is the U.S. National Phase of PCT/GB2015/051161 filed Apr. 17, 2015, which claims priority of Great Britain Patent Application No. 1406959.5 filed Apr. 17, 2014, and Great Britain Patent Application No. 1419368.4 filed Oct. 30, 2014.

FIELD OF DISCLOSURE

This disclosure relates to a downhole tool and to methods of cleaning and cutting. Embodiments of the disclosure have application in hydraulic jetting tools for use in downhole operations.

BACKGROUND TO THE DISCLOSURE

A downhole well is drilled in stages, and casing is run down the inside of the well to support the raw sides once certain depth has been reached. The casing is cemented in place and the process is repeated to the next depth. At each subsequent stage, smaller diameter casing is used.

Alternatively, a liner string is used. In comparison to a casing string, which runs from the well head down the complete length of the well, a liner string is hung from a casing-mounted liner hanger before being cemented in place.

After the casing or liner is cemented in place, and in preparation for the completion phase of the well, drilling fluid or "mud" is circulated out of the well and replaced by substantially solids-free brine. Although solids in the drilling fluid may be necessary or desirable when drilling the well, solids are generally undesirable in the completion phase; the solid particles may clog the producing formation and reduce the flow of the well. The "clean-out" phase conventionally involves circulating "pills" of surfactants into the well and filtration of the circulating fluid to assist in removing solids and clean out the well.

Oil-based drilling muds tend to leave a sticky residue on the wall of the casing. This occurs because of natural oil-wet water-wet separation and even with a good cleaning velocity in a circulating fluid, a small boundary layer by the wall of the casing will be present and this layer is barely moving. Enhanced cleaning may be achieved by directing a treatment fluid through nozzles onto a target area. A controlled rotary motion may be used to achieve complete circumferential treatment. Alternatively, the residue may be physically dislodged from the casing wall using brushes or scrapers.

When commercial production of a well is no longer viable, the well must be decommissioned. For an offshore well, some of the liner and casing is cut and retrieved, the subsea production tree is cut and the well is then plugged. Conventionally, casing is cut by attaching a cutting tool to the end of a work string and running the tool down into the casing.

There are various tools available for downhole cutting and severing of casing strings. These tools utilise multiple extendable arms or blades which rotate outwardly to contact the casing. The work string and cutting tool is rotated causing cutting of the casing string. In some cases the cutting tool is motor driven. For example, US2011220357 (A1) describes a method for milling a tubular cemented in a wellbore including deploying a work string-mounted bottom hole assembly (BHA) into the wellbore through the tubular, the BHA comprising a window mill with extending arms. The method further comprises rotating the work string, extending the arms of the window mill, and radially cutting through the tubular.

SUMMARY

According to an aspect of the disclosure there is provided a downhole tool comprising:

a body having a fluid inlet and a fluid outlet and configured to accelerate fluid flowing along a fluid flow path from the inlet to the outlet;

the fluid outlet being configured to provide a radially directed and substantially circumferentially continuous stream of fluid therefrom.

The tool may be configured to provide a stream of fluid flowing radially outwards from the perimeter of the tool, the stream of fluid extending continuously around the circumference of the tool, such that the stream of fluid may impinge on a circumferential area or surface, for example the inner surface of a downhole tubing.

The fluid flow path may be configured such that fluid may enter the fluid inlet at a first speed and leave the fluid outlet at a higher second speed.

The fluid flow path may be configured such that fluid may enter the fluid inlet in a first direction and leave the fluid outlet in a different second direction.

The first direction will typically be a predominantly axial direction, and the second direction will typically be a predominantly radial direction.

The stream of fluid may have a uniform flow rate from around the perimeter of the tool.

Fluid, typically a liquid, may be supplied to the downhole tool from surface via a conduit, for example a work string. Alternatively, fluid may be provided from a subsurface pump or other subsurface source.

The tool may be mounted on a support member, for example a drill string or work string. The support member may extend from surface through the downhole tubing. The support member may be tubular such that fluid may be directed from surface through the member to the tool.

The tool may be configured to provide a jet of fluid for use in cleaning or treating tubing, or for eroding, forming, cutting or severing tubing downhole. The downhole tubing may be, for example, casing strings or liners, or production screens. The tool may also be useful for cleaning a downhole element or device, such as a valve or a profile.

The fluid outlet may comprise a flow constriction, restriction or nozzle such that when the fluid is directed through the fluid outlet, the fluid is formed into a jet.

The fluid outlet may be less than 5 mm wide, less than 4 mm wide, less than 3 mm wide, or less than 2 mm wide, or around 1 mm wide.

The fluid jet from the fluid outlet may be a continuous jet or a pulsed jet.

The fluid velocity of the jet exiting the tool may be selected as appropriate for the intended tool application, for example the fluid flow rate may be selected and/or the size of the flow constriction, restriction or nozzle through which the fluid passes may be configured to provide the desired fluid velocity. The fluid velocity for a given fluid flow rate may be changed by, for example, adjusting the size of the flow constriction or nozzle prior to positioning the tool in the downhole tubing.

The fluid may travel at a suitable speed to achieve a desired rate of material removal, for example the fluid speed may be 30.8 m/s (100 feet/sec) or more when the tool is being used as a cutting tool or 15.24 m/s (50 feet/sec) or more when the tool is being used for cleaning purposes.

The tool body may comprise an inner body and an outer body, wherein the inner body comprises the fluid inlet, and wherein the outer body comprises the fluid outlet.

The inner body may further comprise a plurality of radial flow passages, wherein fluid is directed into the inner body through the fluid inlet and is directed through the radial flow passages into the outer body and out of the tool through the fluid outlet.

The outer body may be configured to facilitate the formation of a jet of fluid as the fluid passes from the inner body through the outer body and flows out of the fluid outlet.

The outer body may form a fluid outlet flow constriction, restriction or nozzle such that when the fluid is directed through outer body the fluid is formed into a fluid jet.

The outer body may form an outlet conduit or manifold, wherein the conduit or manifold is configured to distribute fluid to the fluid outlet.

The dimensions of the fluid outlet may be selected depending on the application of the tool. The dimensions of the fluid outlet determine the total flow area (TFA) which affects the velocity and pressure of fluid exiting the tool. The operator may select the size of the fluid outlet to optimise the performance of the tool, for example when the tool is to be used for cleaning, the fluid outlet may be larger than when the tool is to be used for cutting, in which case the outlet may be very small in order to achieve a high fluid exit velocity.

The tool may further comprise a member having a dimension or form which may be configured to change the size of the fluid outlet, for example, the member may be a shim, or washer, or ring. In use, the operator of the tool may select any number or dimension of members to determine the size of the fluid outlet, prior to positioning the tool downhole.

The tool may further comprise a means of permitting or maintaining axial fluid passage in the downhole tubing. For example, the outer body may further comprise at least one lateral passage which permits external fluid to flow through or past the body. For example, when the downhole tubing is a casing string, the at least one lateral passage maintains a fluid passage across the tool, thereby permitting fluid to pass through the tool as the tool is moved through the casing string.

The tool may be mounted on the end of a support member, or the tool may be integrated in a support member, that is the support member may continue beyond the tool, extend through the tool, or further tools or devices may be mounted below the tool.

An axial communication passage may extend through the tool to, for example, permit fluid to pass from a support member above the tool to the portion of the wellbore below the tool or to other tools or devices below the tool.

The body may further comprise a bypass device configured to have a closed first position and an activated second position wherein, when the bypass device is in the first position, the fluid flow path is closed; and when the bypass device is in the second position, the fluid flow path is open.

The bypass device may be activated by any suitable activating means. The bypass device may be, for example, ball or dart-activated.

A bypass activating device may be provided and may at least partially close an axial communication passage through the body, such that some or all of the fluid flowing into the tool is directed through the fluid outlet.

The tool may be configured for single use, wherein once the bypass device is in the activated position, it will remain in the activated position.

The tool may be configured for multiple uses, wherein the tool is reconfigurable from the activating position back to the first position, or an alternative closed position, ready for reactivation. The activating means may be retrievable, for example by the provision of a fishable profile, or the activating means may be reconfigurable to allow the tool to return to the first position.

A filter may be provided in conjunction with the tool to filter the fluid being supplied to the tool and thus avoid any larger particles reaching the tool and potentially blocking the flow path through the tool. The filter may be provided at any appropriate location, but may be located at surface to facilitate filter maintenance or cleaning.

The composition of the fluid may be selected depending upon the application of the tool. For example, when the tool is to be used as a cleaning tool, "breaker fluid" may be used. Breaker fluid may be acidic, or may contain surfactants. When the tool is being used as a cutter, an abrasive material, such as sand, may be added to the fluid to enhance the cutting effect. If desired, the same tool may serve as a cleaning tool and a cutting tool. For example, when supplied with fluid absent any abrasive material the tool may be used for cleaning, and when supplied with fluid containing abrasive material the tool may be used for cutting.

The tool may be provided in combination with a gripping or lifting tool, such as a fishing tool, spear or grapple. The gripping or lifting tool may be utilised to retrieve a cut casing or other "fish". The gripping or lifting tool may be provided on a support member, above or below the cutting tool, or may be integrated with the cutting tool.

The tool may be provided in combination with one or more stabilisers, for location above or below the tool, to facilitate centralising and stabilising the tool.

According to another aspect of the disclosure there is provided a method of treating or cleaning downhole tubing, the method comprising directing a jet of fluid at the tubing wall, wherein the jet of fluid is radially directed and substantially circumferentially continuous.

The jet of fluid may travel in a direction that is substantially perpendicular to the tubing wall, or may be inclined to the tubing wall.

The jet of fluid may impinge on a circumferential area or surface, for example the inner surface of downhole tubing.

The downhole tubing may be, for example, casing string and/or liner, a screen, or a completion. The method may also be used for cleaning downhole elements or devices, such as valves or profiles, or seal bores. The method may be used to clean elements of a well head.

The jet of fluid may be provided by a tool run into the tubing on a support member, such as a work string or a drill string, or coiled tubing.

The method may comprise positioning the tool downhole at the location to be cleaned.

The tool may be translated through the tubing as the jet of fluid is directed at the tubing wall. The rate of translation may be selected to provide the most efficient cleaning operation, for example the fastest speed that will achieve the desired degree of cleaning.

If left stationary in the tubing for an extended period, the jet of fluid may erode the surface of the tubing, and ultimately cut through the tubing.

The method may comprise supplying fluid to the tool via a support member, which may be a tubular support member.

The method may comprise accelerating and redirecting fluid supplied through the support member, typically fluid supplied from surface.

The velocity of the fluid jet may be selected to clean the wall of the downhole tubing, for example the velocity of the fluid jet may be selected to cause removal of a particular material from the inner surface of the downhole tubing.

The method may comprise adjusting the flow rate of fluid supplied to the tool.

The method may further comprise selecting the dimensions of a fluid outlet constriction in the tool providing the jet of fluid to provide the velocity of fluid as required by the application. The size of the constriction may selected by an operator prior to running the tool downhole.

The method may further comprise selecting the composition of the fluid to achieve the desired removal of material, for example surfactants or abrasive materials may be added to the fluid.

According to another aspect of the disclosure there is provided a method of cutting or severing downhole tubing, the method comprising redirecting and accelerating a stream of fluid to create a jet of fluid directed at the tubing wall, wherein the jet of fluid is a radially directed and substantially circumferentially continuous stream of fluid and erodes the wall.

The jet of fluid may be provided to impinge on a circumferential area or surface, for example the inner surface of the downhole tubing.

The jet of fluid may travel in a direction that is substantially perpendicular to the tubing wall, or may be inclined to the tubing wall.

The downhole tubing may be, for example casing strings and/or liners, a screen, or indeed any downhole structure.

The jet of fluid may be provided by a tool run into the string on a support member.

The stream of fluid may be supplied from surface through a support member.

The method may comprise positioning the tool downhole at the desired cutting location. The tool may be held stationary at the desired location for a period sufficient for the fluid to cut through the tubing. For certain flow and fluid conditions, translating the tool through the tubing may result in a cleaning or scouring effect, rather than cutting. However, with higher fluid speeds and a relatively slow rate of translation, sections of tubing may be eroded or milled away.

The velocity of the fluid jet may be selected to erode the tubing wall.

The method may comprise adjusting the flow rate of fluid supplied to the tool.

The method may further comprise selecting the size of a flow constriction in the tool to provide the velocity of fluid as required by the application. The size of the constriction may selected by an operator prior to positioning of the tool downhole.

The method may further comprise adding solids to the fluid to increase the rate of material erosion, for example, sand or grit may be added to the fluid.

The method may comprise directing the jet of fluid at the tubing wall and then pulling or lifting the portion of tubing above the cut. If the tubing has been severed and the cut portion of tubing is not otherwise held in position, the cut portion of tubing may be retrieved. However, if the tubing does not move in response to pulling, the cutting operation may be repeated, at the same location or at a location further up the bore, before the pulling operation is tried again. This cycle of cutting and pulling may be repeated until the tubing is retrieved.

Embodiments of the disclosure rely solely or primarily on fluid erosion to provide the cutting action and thus do not experience the same pattern of wear as mechanical casing cutters. Conventional mechanical cutters often must be replaced after a single cutting operation, such that the worn cutter must be tripped out and a new cutter tripped in between cutting operations. This may add significant time and expense to a casing retrieval operation.

The above methods may comprise selecting or configuring a cutting or cleaning tool to locate a fluid outlet in close proximity to the tubing wall, thus minimising energy losses between the jet of fluid exiting the fluid outlet and impinging on the tubing wall. The fluid outlet may be less than 1 cm from the tubing wall.

The method may comprise providing a path for fluid lying in or flowing through a wellbore to flow through or around a cutting or cleaning tool. This may be useful to prevent or minimise swabbing effects as the tool is moved through the fluid-filled wellbore.

The methods as described above may utilise the tool as described above.

It should be understood that the features defined above in accordance with any aspect of the present disclosure, or described below in relation to any specific embodiment of the disclosure, or described in any of the appended claims, may be utilised, either alone or in combination with any other defined feature, in any other aspect or embodiment of the disclosure.

BRIEF DESCRIPTION OF THE DRAWINGS

These and other aspects of the present disclosure will now be described, by way of example, with reference to the accompanying drawings, in which.

DETAILED DESCRIPTION OF THE DRAWINGS

Figure 1:
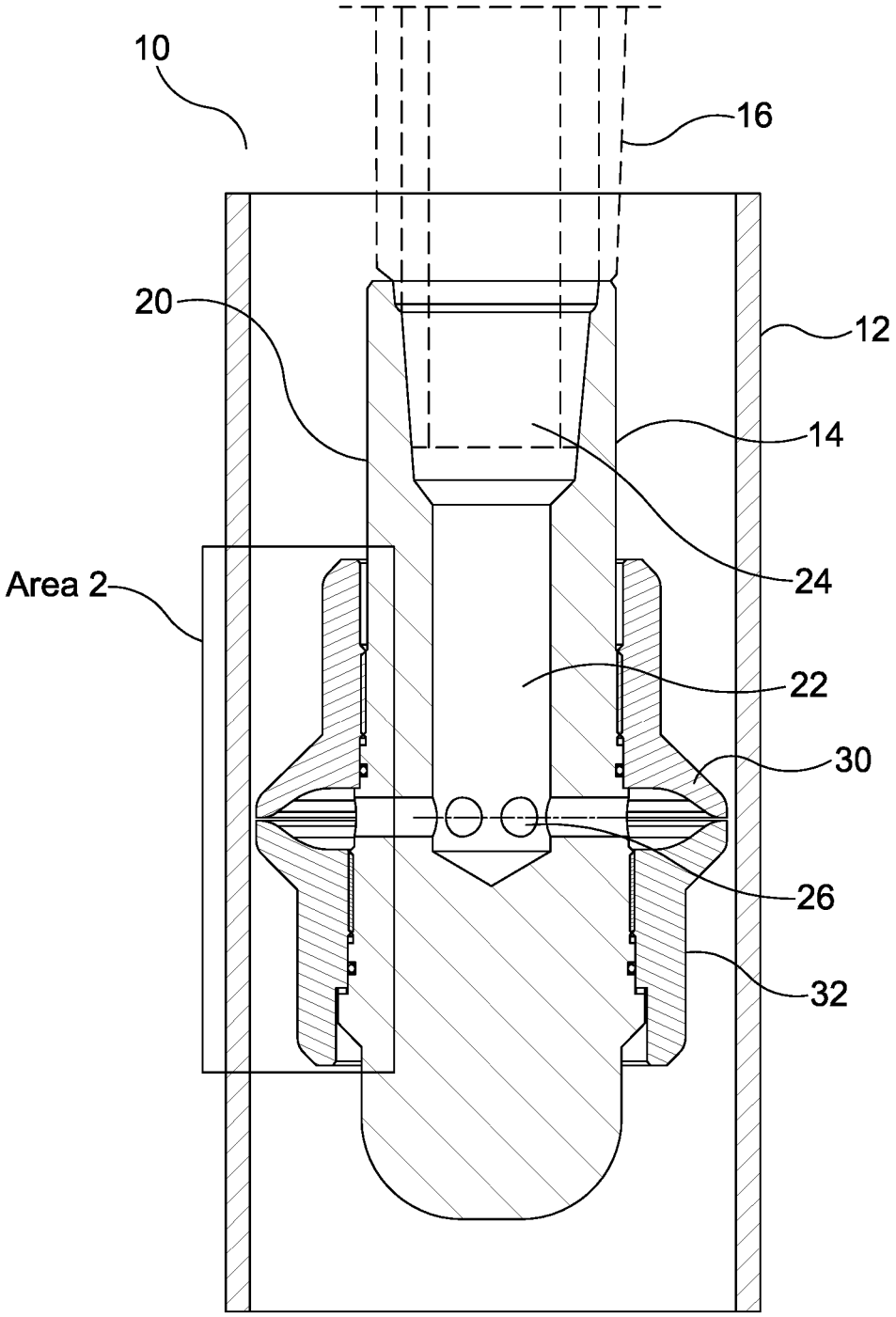
FIG. 1 is a schematic illustration a hydraulic jetting tool in accordance with an embodiment of the present disclosure, located in a section of bore-lining casing.

Reference is made to FIG. 1 of the drawings, which is a schematic illustration of a hydraulic jetting tool 14 in accordance with an embodiment of the present disclosure shown located in a section of wellbore-lining casing 10. The hydraulic jetting tool 14 comprises an inner body in the form of a bullnose sub 20 with a box connection 24 to allow attachment to the lower end of a work string 16, which enables the tool 14 to be supported and run down into the casing 10. The sub 20 has a blind-bore 22 in fluid communication with the bore of the work string 16, and seven 2.54 cm (1 inch) bores 26 drilled radially to provide for fluid communication between the bore 22 and the sub exterior.

The work string 16 extends to surface and, in use, fluid is pumped down the string 16 and into the tool 14. The fluid used will depend on the application of the tool, for example the fluid may be drilling fluid, or a cleaning fluid; and the fluid composition may be selected for the application, for example surfactants or breaker fluid may be added when the tool 14 is to be used in a cleaning operation, or abrasive material may be added to the fluid when the tool 14 is to be used in a cutting operation.

The tool 14 further comprises an outer body in the form of an external housing comprising an upper jetting housing 30 and a lower jetting housing 32, both mounted on the bullnose sub 20. The housings 30, 32 are substantially cylindrical with internal threads 31, 33 configured to engage with corresponding external threads provided on the sub 20. The bottom housing 32 is threaded onto the sub 20 over the upper end of the sub 20 followed by the upper housing 30 which features a slightly smaller internal diameter. In the event of the housings 30, 32 becoming loose on the sub 20, the housing 30, 32 cannot pass over the lower end of the sub 20 and thus will not fall down the wellbore.

Both housings comprise a respective stop shoulder 34 (FIG. 2) for engaging a corresponding shoulder on the sub 20. When the housings 30, 32 are threaded onto the sub 20, the shoulders 34 provide for sealing engagement with the sub 20, when the housings are correctly torqued. O-ring seals 29 are also provided between the upper housing 30 and the sub 20 and between the lower housing 32 and the sub 20, the seals being located in channels cut in the sub 20.

Figure 2:
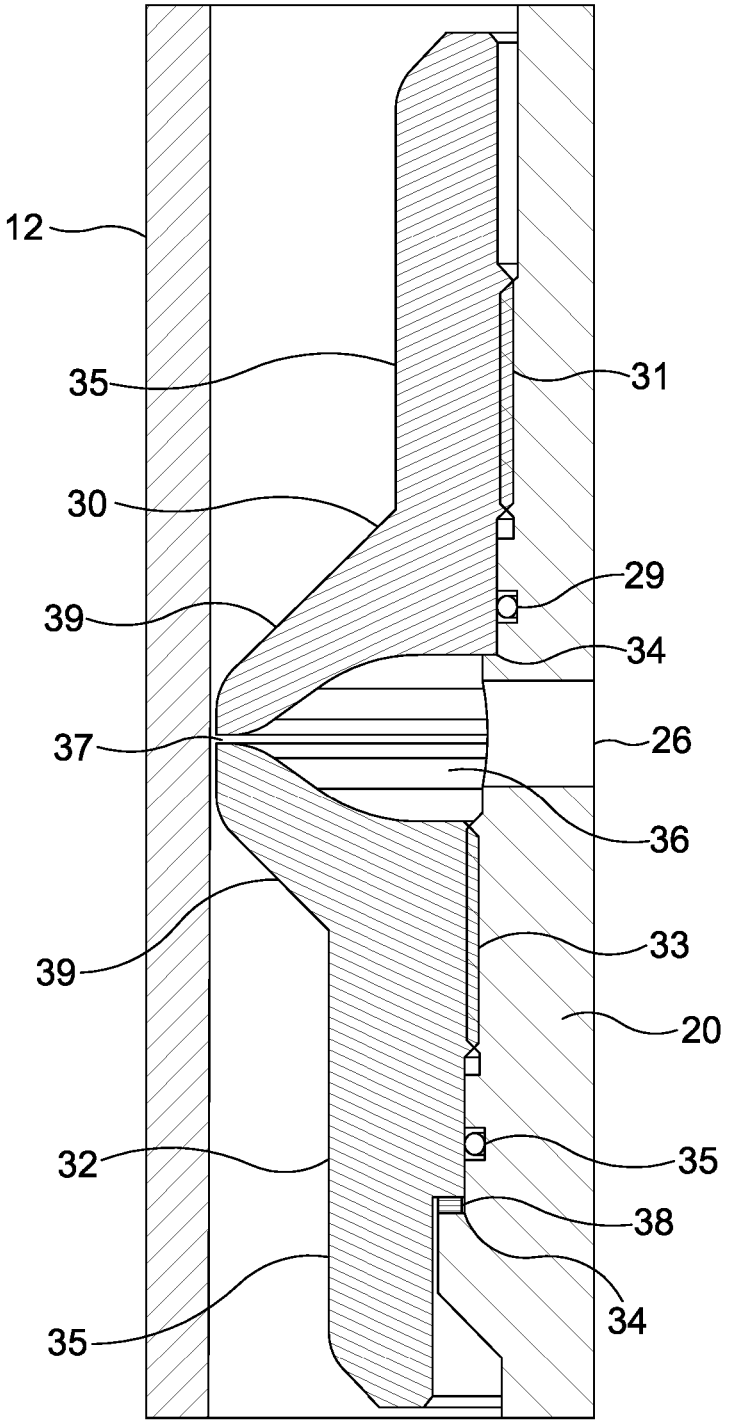
FIG. 2 is an enlarged view of area 2 of FIG. 1.

As illustrated more clearly in FIG. 2, both housings 30, 32 comprise an elongated generally cylindrical portion 35 which transitions into a flared or radially protruding portion 39. When the housings are engaged with the sub 20, the inner surfaces of the radial protruding portions 39 form a circumferential cavity 36 around the outer perimeter of the sub 20 which coincides with the outer ends of the radial bores 26. The circumferential cavity 36 tapers from the region of the radial bores 26 to a constriction 37 formed between the opposing surfaces of the radially protruding portions 39 of the housings 30, 32. The circumferential cavity 36 thus acts as a manifold for fluid passing from the bores 26 and then directs the fluid to the constriction, which acts as a nozzle. Accordingly, as fluid is supplied to the tool 14, the fluid passes through the bore 22 and is directed radially outward through the radial bores 26, into the cavity 36. The fluid is accelerated as it passes radially outwards through the cavity 36 and is forced through the constriction 37 at high speed and is directed at the casing 12. The constriction 37 extends around the circumference of the tool and serves to distribute an even, continuous jet of fluid from the tool.

Figure 3:
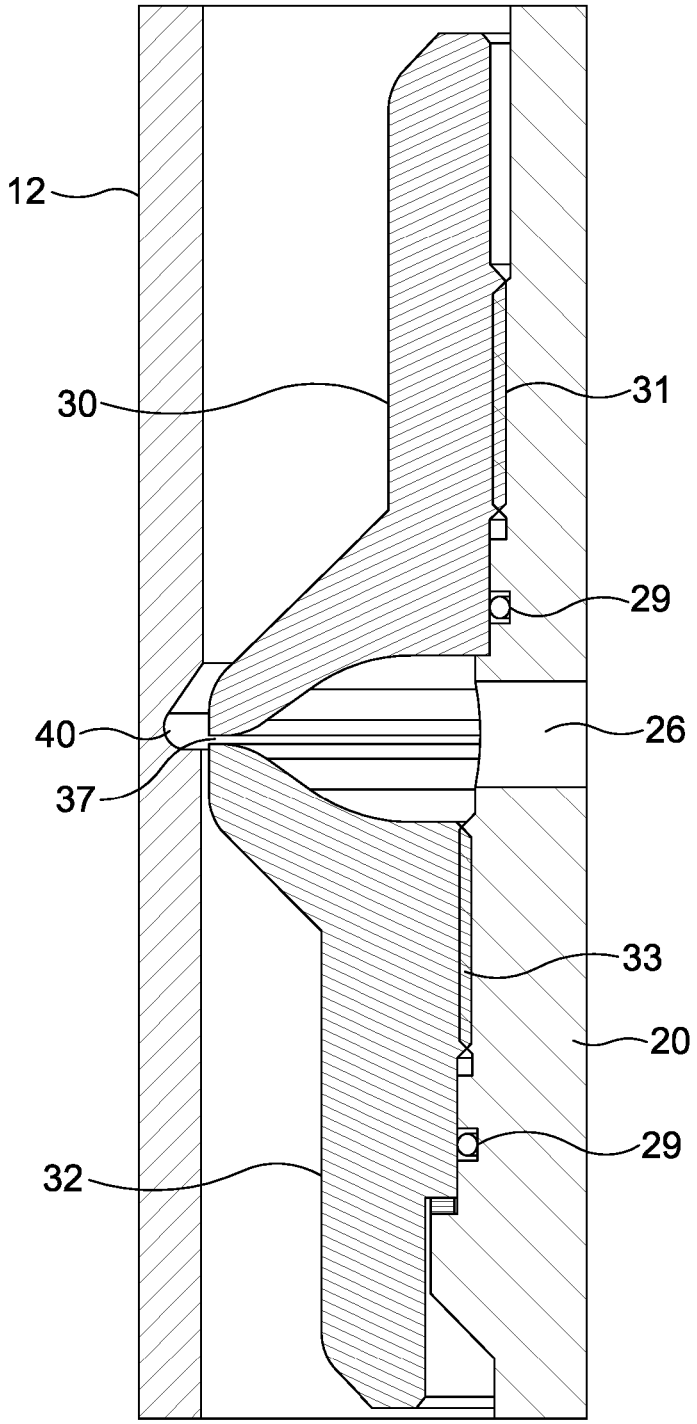
FIG. 3 is an enlarged view of area 2 of FIG. 1, illustrating erosion of the casing wall.

The housings 30, 32 are sized such that the tool fluid outlet, defined by the constriction 37, is positioned close to the inner wall of the casing. As distance from the constriction 37 increases, the energy of the fluid is dissipated and thus, particularly when the tool is to be used as a cutting tool, it is desirable to have a very small distance between the constriction 37 and the casing wall 40 such that the energy of the fluid hitting the wall 40 is sufficient to cause erosion of the casing, as illustrated in FIGS. 2 and 3. For example, for a standard 101.2 kg/m 339.7 mm (68 lb./foot 13-⅜") casing with an internal diameter of 315.314 mm (12.415"), the outer diameter of the housings 30, 32 can be 311.15 mm (12.25"); the distance between the housings and the casing wall is thus only 4.164 mm. The distance between the housing and the casing wall may be, for example, less than 4 mm, or greater than 4 mm and preferably no more than 8 mm.

The surfaces of the housings 30, 32 and the sub 20 that will be in contact with the high speed fluids are coated with a suitable hard-facing material such as tungsten carbide to prevent or minimise erosion. Alternatively, the parts may be formed of a ceramic or other erosion resistant material.

The tool 14 is provided with a small ring or shim 38 to be fitted on the shoulder 34 of the lower housing 32 (FIG. 2). The number or size of shims 38 is selected to facilitate control of the size of the constriction 37 between the two housings 30, 32. The size of the constriction determines the Total Flow Area (TFA) which directly affects the velocity of the fluid being directed at the casing 10, for a given flow rate of fluid.

In use, the supplier or operator of the tool 14 sets the size of the constriction 37 to optimise the performance of the tool. For example, if the tool is being utilised in downhole cleaning operations, the supplier or operator may wish to make the constriction 37 larger in order to clean the casing wall 40 whilst preventing or minimising the risk of fluid erosion of the casing. Alternatively, if the tool is being utilised as a cutting tool, the operator or supplier may select a number of shims 38 to reduce the size of the constriction 37 to increase the exit velocity of the fluid. For example, when the tool is being used as a cutting tool, the constriction 37 may be less than 4 mm (0.157") or less than 8 mm (0.316"). When the tool is being used as a cleaning tool, the constriction 37 may be less than 10 mm (0.394").

The casing can be eroded, as illustrated in FIG. 3, by maintaining the tool in a static position, increasing the flow rate of fluid supplied to the tool and directing the fluid with high exit velocity directly at the casing, causing fluid erosion of the casing wall 40. In use, the tool 14 may be mounted onto a work string 16 and lowered into a casing string 10 to any position in the string for cutting at that position. Fluid is pumped down the work string 16 to the tool 14. It may be desirable to add an abrasive material such as a fine sand or grit to the fluid to increase the rate of fluid erosion. The tool 14 is held in a static position with fluid eroding the adjacent casing wall 40 until the entire depth of the wall has been eroded and the casing 10 severed. The tool may be held in the static position and fluid flow maintained for an appropriate time, for example 10 minutes, or for as long as is required for the casing to be completely severed. As the casing wall 40 is eroded, the distance between the constriction 37 and the wall 40 will increase. To maintain a fluid velocity sufficient to continue to erode the wall 40 at a desired rate as this distance increases, the exit fluid velocity from the constriction 37 may be increased by, for example, increasing the fluid flow rate to the tool. Alternatively, the fluid velocity may be maintained substantially constant throughout the cutting process, although the rate of erosion of the casing wall may not remain constant. For example, the fluid velocity of the fluid exiting the constriction may be maintained at 30.8 m/s for cutting of the casing. During a cutting operation of the tool 14, the casing string 10 may be pulled or twisted if necessary, to aid in severing of the casing string. A fishing spear or grapple (not shown) is mounted on the work string 16 above the tool 14 to retrieve the upper length of severed casing.

Stabilisers may also be provided on the work string 16, to assist in locating and maintaining the tool 14 centrally in the casing 10. The pumping of fluid through the tool 14 at high flow rates, and the acceleration of the fluid in the tool 14, generates very significant forces and may induce significant vibration. The provision of stabilisers supports the tool 14 and minimises the effects of such forces and vibration.

When cutting a section of casing, the tool 14 provides the operator with the ability to make several attempts at severing and pulling the casing. For example, in some instances it may not be possible to pull the casing from the wellbore even after the casing has been severed. In this situation, the tool 14 may be raised to a higher section of the casing, and the severing process can be repeated at this new position and so forth until the casing can be successfully pulled up from the well. The tool 14 does not tend to experience the severe wear typically seen in mechanical cutters, such that the need for tripping between cuts to replace or repair a worn cutting tool is minimised or eliminated.

In use as a cleaning tool, the tool 14 may be mounted on the work string 16 and lowered into a casing string 10 to any location to be cleaned. The tool 14 may also be used to clean production screens. The composition of the fluid supplied to the tool 14 is chosen for the particular cleaning operation, for example it may be desirable to add surfactants to the fluid. The tool 14 can be held in a static position for any suitable time to remove material from the surface of the casing, for example 10s, 20s, 30, 1 minute, less than 1 minute, or for between 1 minute to 20 minutes. Alternatively, it may be desirable to move the tool 14 whilst fluid is being supplied to the tool and directed at the casing surface, for example the operator may move the tool 14 up through the casing as the tool 14 is in use, providing cleaning to a length of casing. The fluid velocity of the fluid exiting the constriction 37 may be maintained at, for example 15.24 m/s for a cleaning operation. It may be desirable to operate at a lower or higher fluid velocity depending on the amount and type of material to be removed during the cleaning operation, and the surface properties of the material to be cleaned.

Figure 4:
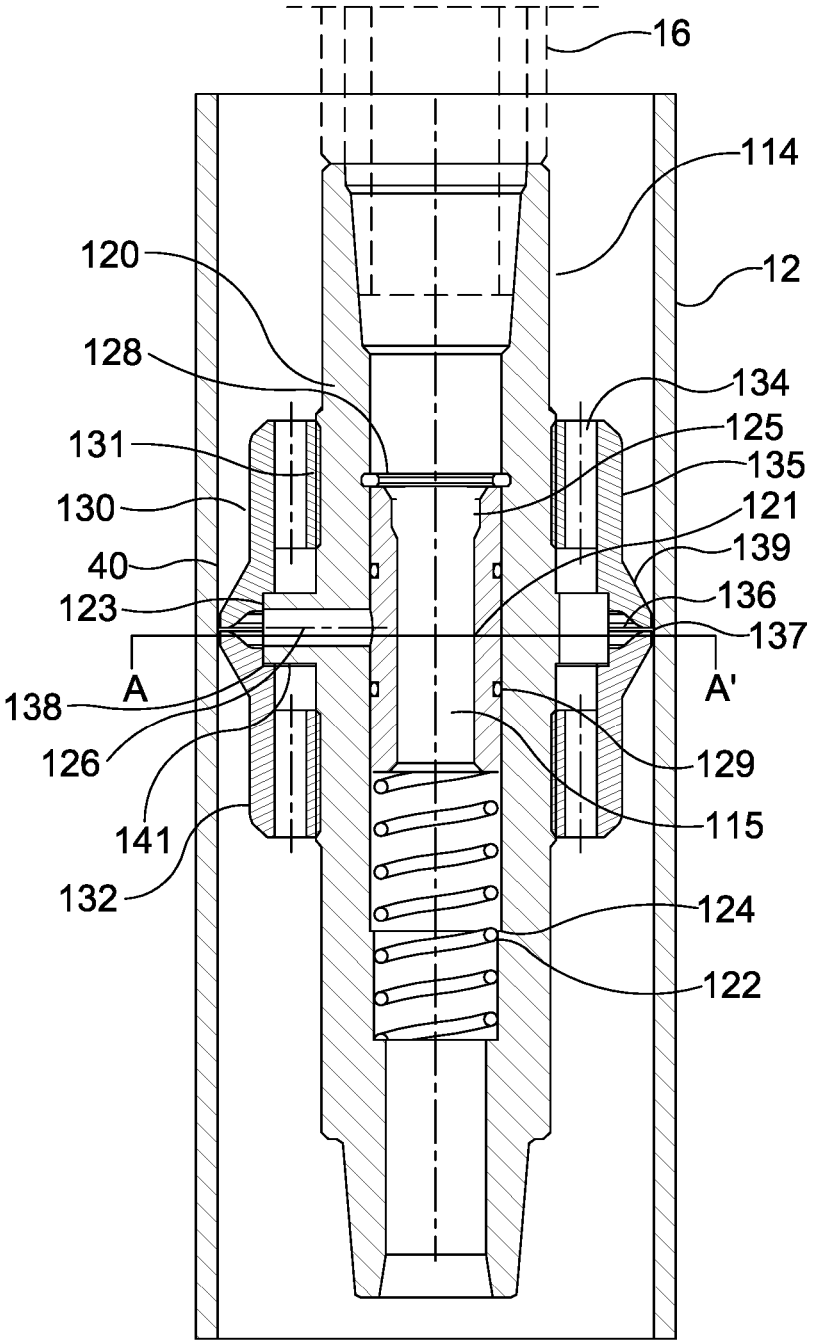
FIG. 4 is a schematic a hydraulic jetting tool in accordance with another embodiment of the present disclosure, shown located in a section of bore-lining casing.

Reference is made to FIG. 4 of the drawings, which is a schematic illustration of a hydraulic jetting tool 114 in accordance with another embodiment of the present disclosure, shown located in a section of wellbore-lining casing 10. As will be described, this tool 114 has a dormant configuration and an active configuration.

The hydraulic jetting tool 114 may be mounted in a drill string 16 above a drilling bottom hole assembly (BHA) wherein drilling fluid is pumped through the tool 114 to the BHA whilst the tool is in the dormant configuration. It is envisaged that planned drilling can take place below the tool 114, for example drilling of formation or excess cement plugs, and the tool 114 can then be activated and the drilling fluid redirected through the tool to cut or clean the casing above the BHA after the drilling operation has been completed.

Alternatively, or in addition, the tool 114 may be utilised to clean other elements of the well, or localised areas, for example seal bores intended for engaging with liner hanger seals, or elements of a well head, such as a well head seal profile.

The hydraulic jetting tool 114 incorporates a bypass feature which allows fluid pumped to the tool to pass through the tool unobstructed whilst the tool is in the dormant configuration. In the active configuration, the fluid supplied to the tool no longer passes through the tool but is redirected to exit the tool and provide for either cleaning or cutting of the surrounding casing.

The hydraulic jetting tool 114 comprises a hollow inner body 120 with seven 2.54 cm (1 inch) equally spaced bores 126 drilled radially through the body 120 to intersect a through-bore 115 which runs axially through the centre of the tool 114. The tool 114 comprises a spring-loaded sleeve 121 which seals off the bores 126 when the spring 122 is extended, as illustrated in FIG. 4. Fluid supplied to the tool will pass through the through-bore 115, whilst the radial bores 126 are sealed off by the sleeve 121.

The spring-loaded sleeve 121 is positioned within the hollow body 120 and comprises a profile 125 configured to catch an activating device, in this example a ball 50. A spring-clip 128 limits upward travel of the sleeve 121. Seals 129 are provided between the sleeve 121 and the body 120 to prevent fluid leakage between the opposing sleeve and body surfaces whilst the tool is in both the dormant and active configuration.

The tool 114 further comprises an outer body comprising an upper jetting housing 130 and a lower jetting housing 132 mounted on the inner body 120. The housings 130, 132 are substantially cylindrical with internal threads 131, 133 configured to engage with external threads provided on the body 120.

Both housings 130, 132 comprise a cylindrical elongated portion 135 which transitions into a flared or radially protruding portion 139. When the housings are engaged with the body 120, the radial protruding portions 139 form a hollow circumferential cavity 136 around the outer perimeter of the body 120 which coincides with the outer ends of the radial bores 126. The circumferential cavity 136 tapers from the region of the bores 126 to a constriction or gap 137 formed between the opposing outer faces of the radially protruding portions 139. The cavity 136 thus acts as a manifold and a nozzle, accelerating fluid towards the constriction 137, wherein fluid is forced through the constriction 137 and is directed radially outward around the circumference of the tool providing a consistent, circumferential jet of fluid.

The surfaces of the tool 114 that will be in contact with the high speed drilling/wellbore fluids are coated with a hard-facing material such as tungsten carbide to prevent erosion. Alternatively, the fluid-contacting parts may be formed of ceramic or other erosion-resistant material.

The inner body 120 further comprises a radial protrusion 123 through which the radial bores 126 extend. The radial protrusion 123 is formed integrally with the body 120. This allows for easier construct and engineering of the tool; the tool 114 has relatively few parts and requires only a few seals to ensure reliable operation. Alternatively, the radial protrusion could be a separate component to the body. This could provide for less expensive manufacture of the tool. However a non-unitary radial protrusion element would need to be secured on the body such that the sections of the radial bores 126 in the protrusion element were correctly lined up with the sections of the radial bores 126 in the body, and would remain in that position. This would also require provision of additional sealing features.

The lower housing 132 is threaded onto the body 120 from the bottom, and the upper housing 130 is threaded onto the body 120 from the top. Both housings 130, 132 comprise stop shoulders 134 which engage with the radial protrusion 123, forming metal-to-metal seals 141. The seals 141 are required to withstand the high pressure differential between the high pressure fluid in the tool 114 compared with the relatively low pressure fluid in the annulus 117 between the tool 114 and the casing string 12, and any leak path between the parts would likely experience rapid erosion, disabling the tool.

Figure 5:
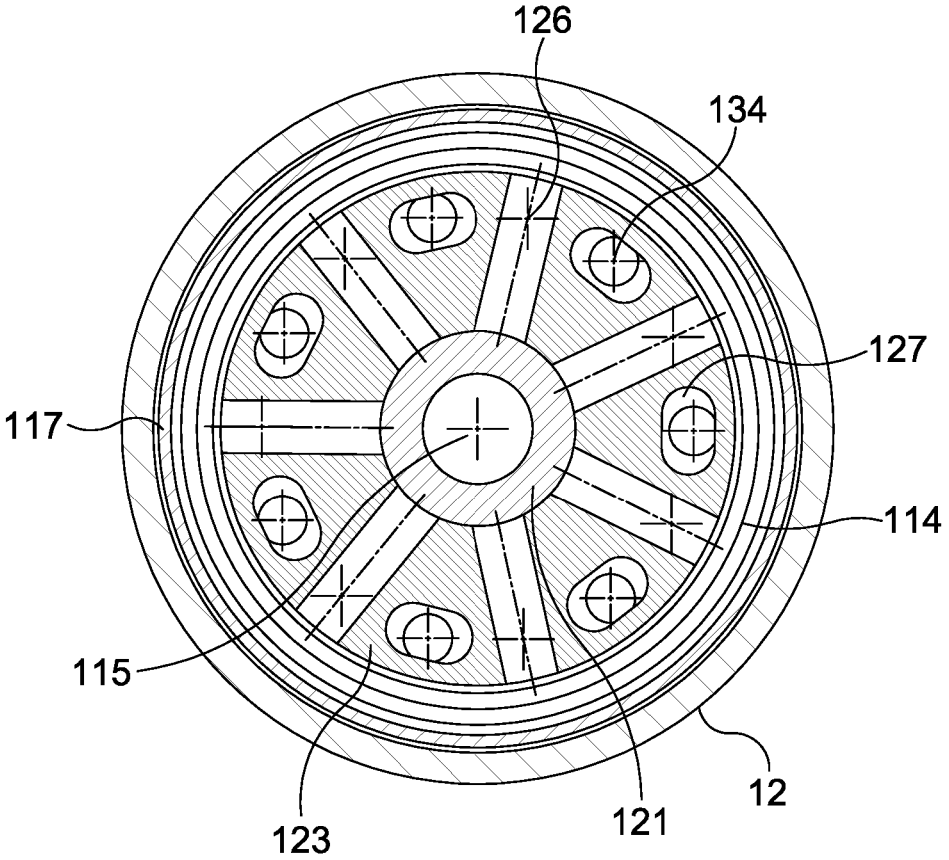
FIG. 5 is a cross-sectional view of the hydraulic jetting tool of FIG. 4 at line A-A'.

The radial protrusion 123 further comprises seven slotted fluid passages 127 which run longitudinally, parallel to the through-bore 115. The slotted passages 127 are positioned between the radial openings 126 (FIG. 5). Each of the upper housing 130 and the lower housing 132 further comprise seven 2.54 cm (1 inch) lateral fluid passages 134. The seven lateral passages 134 in the housings are positioned to align with the slotted passages 127 formed in the radial protrusion 123 to provide an annular flow path between the portions of the annulus 117 above and below the tool 114.

FIG. 5 illustrates a cross-section view of the tool 114 at the radial bores 126 when the tool is in the dormant configuration (indicated by line A-A' on FIG. 4). In this configuration, the through-bore 115 allows fluid to flow through the tool 114 substantially unrestricted. However, the tool 114 substantially occludes the annulus 117 between the tool 114 and the casing string 12. As discussed above in relation to the earlier embodiment, this is desirable to locate the tool fluid outlets close to the casing wall in order to achieve fluid erosion or effective cleaning of the casing wall. For a standard 101.2 kg/m 339.7 mm (68 lb./foot 13-⅜") casing with an internal diameter of 315.314 mm (12.415"), the outer diameter of the housings 130, 132 can be 311.15 mm (12.25"), meaning the distance between the housings, when the tool is located centrally within the casing, and the casing wall is 2.082 mm. The distance between the housing and the casing wall may be, for example, less than 4 mm, or greater than 4 mm and no more than 8 mm, depending on the application of the tool.

The tool 114 may be configured for single or multiple uses. A single use tool 114 utilises an activation means which does not allow the tool to be reconfigured back to a dormant configuration after the tool has been activated whereas a multiple use tool utilises an activation means which enables the operator to reconfigure the tool back to a dormant configuration after use of the tool 114.

Figure 6:
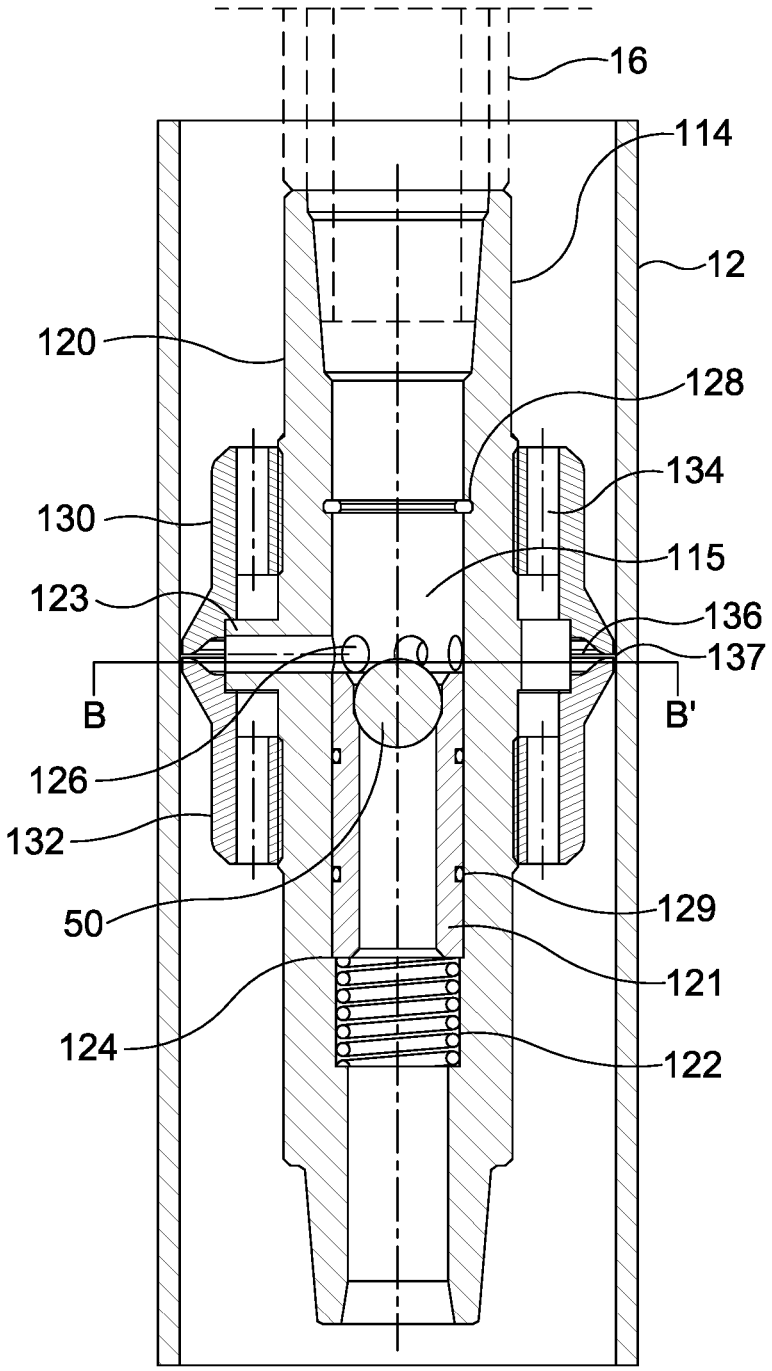
FIG. 6 is a schematic illustration of the tool of FIG. 4 in an activated second configuration.
Figure 7:
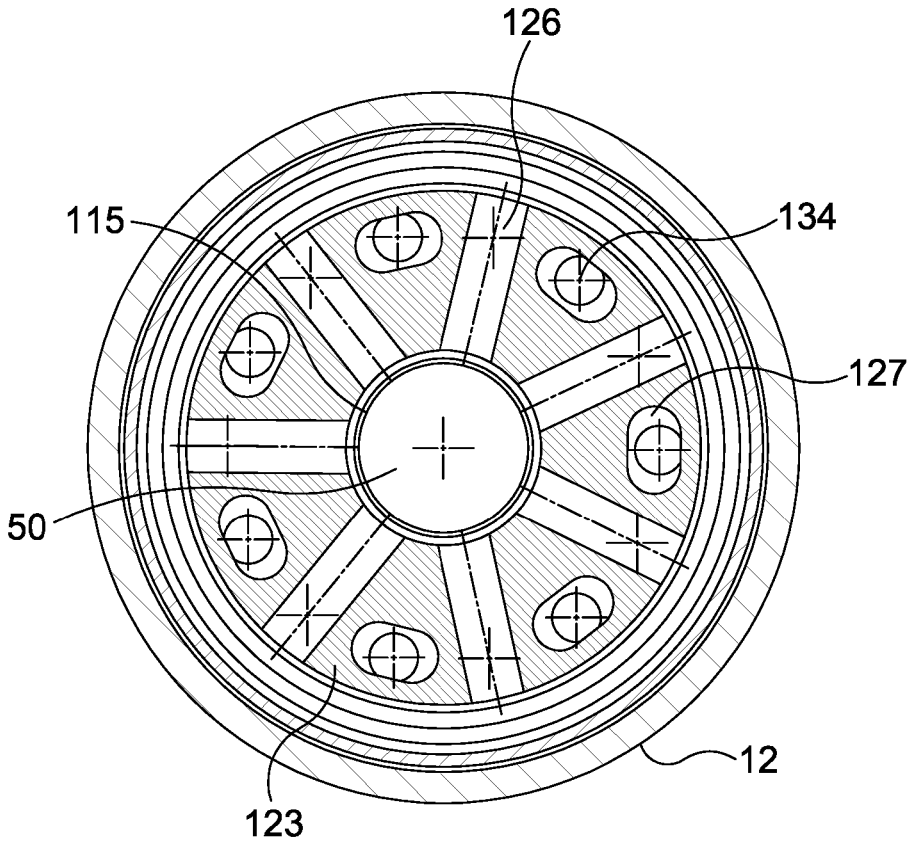
FIG. 7 is a cross-sectional view of the tool in FIG. 6 at line B-B' in the activated second configuration.

In this particular embodiment the tool is ball activated. When a ball 50 is dropped into the tool and is caught by sleeve 121, the ball 50 occludes the through-bore 115, completely blocking onward flow (FIGS. 6 and 7). If fluid continues to be pumped into the tool 114, and because onward flow through the tool 114 is prevented, there is a build-up of pressure above the occluded sleeve 121, the ball and sleeve acting as a large-diameter piston. Under the influence of this fluid pressure, the sleeve 121 moves downwards through the body 120, compresses the spring 122, and reconfigures the tool to the activated configuration, where the radial bores 126 are open, and no longer blocked by the sleeve 121. The sleeve 121 will bottom out on a shoulder 124 formed in the body 120. The pressure differential across the ball 50 and sleeve 121 maintains the sleeve 121 and spring 122 in the retracted position. The sleeve 121 and spring 122 will return to their first, closed position, closing the radial bores 126, if the flow of fluid ceases. However, in the activated configuration, all the fluid being pumped from surface is directed through the bores 126 into the circumferential cavity 136 and thence out through the circumferential constriction 137.

Although this embodiment is ball activated, the bypass feature may be activated by any suitable means. However, the activation means must be designed to withstand the high pressures generated by the jetting fluid, for example ball 50 is formed from a hard, non-resilient material. Commonly used diverting balls are formed of elastic materials such as nylon or crystalline thermoplastic polyester; these balls would likely be unsuitable for use with the illustrated tool 114 because the ball would be unable to withstand the high pressure of the fluid acting on the ball.

In another embodiment, the bypass feature may be dart activated. The dart may be retrievable, for example a fishable dart. This could allow for the bypass feature to be reconfigured back to a closed position upon removal of the dart after use of the tool 114 by running in a wireline provided with an appropriate fishing tool. Additionally, a ported dart could be deployed to enable split-flow jetting, that is the flow of fluid would be split between the cutting/cleaning path and continuing down through the string 16 below the tool 114.

Although not shown in this embodiment, the tool 114 may also be provided with a ring or shim to fit within the lower housing 132, allowing the operator to alter the size of the constriction 137 prior to deployment of the tool 114 downhole. Changing the constriction size 137 will change the velocity of the fluid jet exiting the tool as required by the application of the tool.

For use as a cutting tool, the tool 114 may be mounted at any position in a work or drill string 16, for example above a bottom hole assembly (BHA) or another tool assembly. The work string 16 can be lowered into a casing string 10 to locate the tool 114 at any selected position in the string, for cutting at that position. The tool 114 is initially in the dormant configuration whereby fluid passes through the tool 114. When it is desired to commence a cutting operation, a ball 50 is dropped or pumped into the work string 16 until the ball 50 lands on the sleeve profile 121 and occludes the tool through-bore 115. The fluid flow is maintained and the tool 114 is reconfigured to its active configuration, whereby fluid carrying an abrasive material is directed at the casing radially from the tool 114. The tool 114 is held in a static position with fluid eroding the casing wall 40 until the entire depth of the wall has been eroded and the casing string 10 has been severed. The tool may be held in the static position and fluid flow maintained for an appropriate time, for example 10 to 40 minutes, or for as long as is required for the casing to be completely severed. As the casing wall 40 is eroded, the distance between the constriction 137 and the surface of the wall 40 will increase. To maintain a fluid velocity sufficient to continue to erode the wall 40 at a desired rate as this distance increases, the exit fluid velocity from the constriction 137 may be increased by, for example, increasing the fluid flow rate to the tool. Alternatively, the flow rate may remain constant, but the erosion rate may decrease as the depth of the cut increases. For example, the fluid velocity of the fluid exiting the constriction may be maintained at 30.8 m/s for cutting of the casing. During a cutting operation of the tool 114, the casing string 10 may be pulled or twisted if necessary, to aid in severing of the casing string. A fishing spear or grapple, which may also be mounted on the work string 16, may be utilised to retrieve the severed casing.

One advantage of the disclosed tool is that the energy of the fluid dissipates with increasing distance from the tool. Accordingly, once the casing wall 40 has been cut, if there is another casing beyond the cut casing, the increased distance from the tool makes it unlikely that the outer casing will experience any significant erosion if the tool remains in operation.

To pause the cutting operation, the flow of fluid may be stopped or reduced temporarily.

When seeking to cut and retrieve a section of casing, the tool 114 provides the operator with the ability to make several attempts at severing and pulling the casing, the pulling operation utilising a fishing spear or grapple mounted on the string 16 above the tool 114. For example, in some instances it may not be possible to pull the casing from the wellbore even after the casing has been severed. In this situation, the tool 114 may be raised to a higher section of the casing, and the severing process can be repeated at this new position and so forth until the casing can be successfully pulled up from the well; the tool 114 does not experience the severe wear patterns experienced by mechanical cutters.

If multiple cuts have been made in a casing before the casing has been freed, the operator may choose to then attempt to retrieve the relatively short cut sections of casing below the freed section. Alternatively, an operator may choose to make a first cut and then free a section of casing, before making a second cut lower in the casing and then freeing a second section of casing.

When the cutting operation is complete, the fluid flow to the tool may be increased to the point that the ball 50 is blown through the tool 114. Alternatively, if other forms of activating devices are used, for example an extrudable dart, or a dart with a retractable profile, a fishable dart or an erodible dart, the device may be blown through the tool 114, reconfigured and then passed through the tool 114, retrieved or eroded such that the tool returns to its dormant configuration. The work string 16 may then be moved to reposition the tool 114 for further use.

In use as a cleaning tool, the tool 114 may be mounted at any position on the work or drill string 16, for example above a BHA or another tool assembly and lowered into a casing string 10. Fluid is supplied to the tool 114 from surface through the string 16. Initially the tool 114 is in its dormant configuration and fluid can pass through the tool. When it is desired to commence a cleaning operation, a ball 50 is dropped or pumped into the work string 16 and the tool 114 is reconfigured to the active configuration. This may be preceded by a period during which clean or filtered fluid is circulated through the string 16. The tool 114 can be held in a static position for any suitable time to remove material from the surface of the casing, for example 10s, 20s, 30, 1 minute, less than 1 minute, or for between 1 minute to 20 minutes. It may be desirable to move the tool 114 whilst fluid is being supplied to the tool 114 and directed at the casing surface, for example the operator may move the tool 114 up through the casing at a controlled rate as the tool 114 is in use, providing cleaning to a length of casing. The fluid velocity of the fluid exiting the constriction 137 may be maintained at, for example 15.24 m/s for a cleaning operation. It may be desirable to operate at a lower or higher fluid velocity depending on the amount and type of material to be removed during the cleaning operation. When the cleaning operation is completed, the tool 114 may be reconfigured back to the dormant configuration as discussed above with reference to the cutting operation.

If desired, two or more tools 114 may be provided on a single work or drill string. A second tool may be provided as a back-up to a first tool. Alternatively, for use in tapered strings, the tools may have different external diameters, so that one tool may be used in the smaller diameter section of the string and the other tool may be used in the larger diameter section of the string.

The cleaning tool may be used in the course of a cleaning operation that involves circulating out wellbore fluid and replacing that fluid with a clean fluid, typically brine. The cleaning tool may be provided in combination with brushes, scrapers and mills. The cleaning tool may be mounted on a string below the brushes and scrapers, and above the mill. In one embodiment, the cleaning tool is moved over the casing wall after any casing wall-contacting cleaning tools. The cleaning tool may thus be utilised to provide a final, finishing clean to the casing wall.

By way of example, Table 1 below sets out some exemplary dimensions and flow rates for cutting and cleaning tools.

TABLE 1

| (a) | (b) | (c) | | (d) | (e) | | (f) | (g) | (h) | (I) |
|---|---|---|---|---|---|---|---|---|---|---|
| Diam(in) | Circum(ft) | gpm | cu-ft/s | Ft/s | Gap(in) | (mm) | TFA ($in^2$) | DP (psi) | HHP (ft · lbs/s) | HHP/in |
| 6 | 1.57 | 350 | 0.94 | 200 | 0.036 | 0.92 | 0.67 | 224 | 45.7 | 2.43 |
| 8.5 | 2.23 | 550 | 1.47 | 200 | 0.04 | 1.02 | 1.06 | 224 | 71.9 | 2.69 |
| 12.25 | 3.21 | 1000 | 2.68 | 200 | 0.05 | 1.28 | 1.93 | 224 | 130.7 | 3.4 |
| 17.5 | 4.58 | 1200 | 3.21 | 200 | 0.042 | 1.08 | 2.31 | 224 | 156.8 | 2.85 |

Column (a) of the table lists four exemplary tool diameters, which coincide with standard oil industry drill bit diameters. These tool sizes are matched to standard oil industry casing diameters (7", 9⅝", 13⅜" and 18⅝"). Thus, the 6" tool would be used in standard 7" (outer diameter) casing, which typically has an internal diameter of 6.184", leaving an annular gap between the periphery of the tool and inside wall of the casing of 0.092".

Column (b) identifies the tool circumference.

Column (c) identifies an exemplary cutting/cleaning flow rate, which has been selected to match the standard oil industry flow rate for a drilling operation using a drill bit of the same diameter as the tool. This illustrates that the cutting and cleaning operations may be carried out using standard flow rates well within the operating parameters of standard oil industry equipment.

Column (d) identifies an exemplary jet speed of 200 feet/second which is effective for both cutting and cleaning.

Column (e) identifies the size or width of the gap 137 which will provide the desired jet speed for the given flow rate.

Column (f) identifies the total flow area (TFA) provided by the given circumferential gap 137.

Column (g) identifies the pressure drop which will be seen in the fluid as it passes through the gap 137 (based on a 10 lb/g drilling mud).

Columns (h) and (i) identify the hydraulic horsepower (HHP) generated at the tool outlet and the hydraulic horsepower per linear inch around the circumference of the tool. By way of comparison, the fluid hydraulics energy across the nozzles of a drill bit may be in a range of 2.0 to 7.0 HHP.

These exemplary tool dimensions and flow rates may be useful in a casing cleaning operation or a casing cutting operation. The cutting operation may be facilitated by the inclusion of an abrasive material in the fluid.

Of course different flow rates, jet speeds and gaps sizes may be utilised, as desired, and as appropriate for a particular application. For example, it may be desired to supply fluid to a tool at a higher flow rate, providing greater hydraulic horsepower at the fluid outlet. This greater power could be utilised to obtain a higher rate of erosion. Indeed, it many situations it is likely to be possible to achieve a pressure drop of 300-1000 psi or more across the gap 137 without requiring provision of specialist supporting equipment, although at higher pressure drops it may be beneficial to configure the string to minimise pressure drops in other areas and locations. With higher hydraulic horsepower, perhaps combined with selection of an appropriate abrasive material additive, the resulting erosive power could be used to erode or remove a length or section of casing, rather than simply cutting a slot in the casing. This could be achieved by moving the tool slowly down through the section of casing at a controlled rate. At present, such an operation would typically involve milling out a section of casing, which operation generates a very large volume of metal swarf.

Figure 8A:
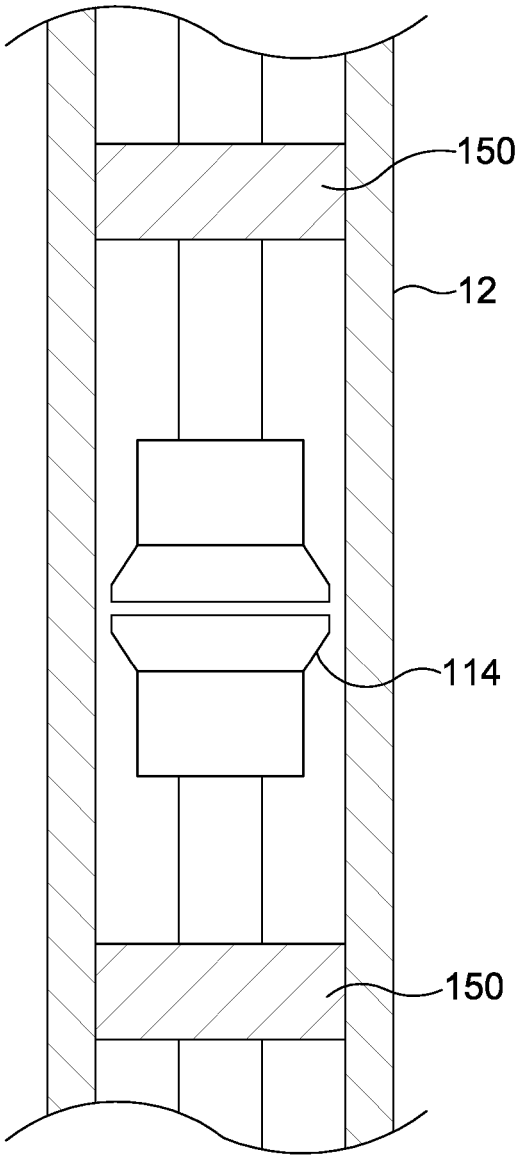
FIG. 8A is a schematic illustration of the hydraulic jetting tool of FIG. 4, mounted in a work string between stabilisers.
Figure 8B:
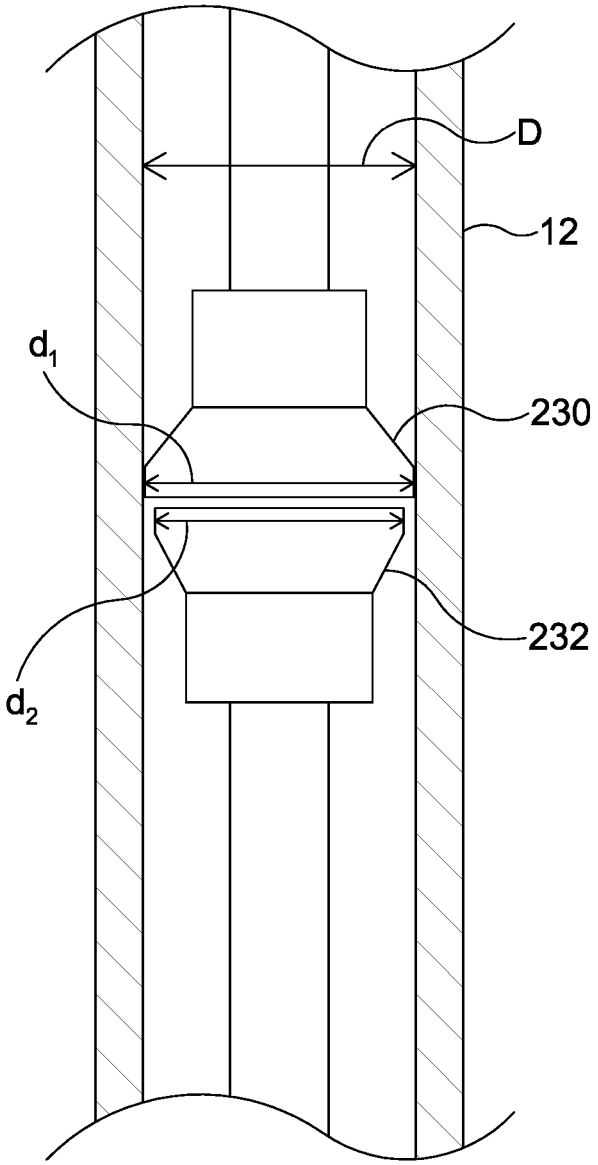
FIG. 8B is a schematic illustration of a hydraulic jetting tool with housings of different outer diameters.

In both embodiments described above, the outer diameters of the upper and lower housings are the same. In some situations when the tool is deployed downhole, one side of the tool may contact the casing whilst the other side may be further away from the casing, for example when the tool is positioned in a horizontal section or inclined section of tubing. The tool may be centralised by positioning one or two slightly larger conventional stabilisers 150 below and above the tool 114 (FIG. 8A), thus preventing uneven erosion or cleaning of the wall due to offset positioning of the tool in the string. The stabilisers also serve to support the tool in the bore and limit the amplitude of vibration experienced by the working tool. Alternatively, or in addition, the outer diameter $d_1$ of one housing, in this example the upper housing 230, can be constructed to be slightly smaller than the outer diameter $d_2$ of the other housing 232, to provide a minimum standoff for the fluid to hit the casing, as illustrated in FIG. 8B.

The skilled person will appreciate that tools of the present disclosure provide a jet of fluid which is radially directed and substantially circumferentially continuous so that the jet impinges simultaneously on the entire circumference of the casing string wall and allows for even removal of material from the wellbore wall. Thus, tools of the present disclosure may be used without the need for the tools to be rotated to ensure even coverage around the casing wall. Providing a tool with reduced reliance on motors is a major advantage; rotating tools conventionally rely on mud motors which use hydraulic power and introduce a further potential source of operational failure. Furthermore, a cleaning tool with reduced reliance on motors may have particular advantages when used for cleaning mesh on production screens. Production screens may become clogged during production or may require cleaning as part of their installation and it is necessary to be able to unclog the mesh without causing damage; rotating tools inside a production screen may make such damage more likely. However, the skilled person will recognise that the tools described herewith may be rotated in use if considered desirable, for example support webs inside a tool housing may reduce the power of the cutting or cleaning jet at certain circumferential locations, such that a degree of rotation of the tool may be desirable to provide more even cutting or cleaning.

When the hydraulic tools of the present disclosure are used to cut or sever a casing string, the fluid erosion of the string produces a very fine metal dust which can be easily removed from the fluid using ditch magnets or the like. There is no requirement for additional filters to remove the metal dust. In comparison, and as noted above, conventional mechanical cutting tools produce large quantities of metal swarf. Such swarf tends to be difficult to circulate out of a wellbore and can infiltrate into other equipment and cause damages to seals, for example.

The skilled person will realise that the above described and illustrated embodiments are merely exemplary of the implementations of the present disclosure and that various improvements and modifications may be made thereto, without departing from the scope of the invention. For example, reference is made herein primarily to cutting and cleaning of casing, however the skilled person will realise that the tools and methods disclosed herein will have application in cutting and cleaning other structures. Also, reference is made primarily herein to mounting of the cutting and cleaning tools on work strings or drill strings. The tools could also be mounted on other forms of support, such as coiled tubing, which would permit the tools to be run into and retrieved from a well bore relatively quickly.

The invention claimed is:

1. A downhole tool configured to receive a supply of fluid from a surface location, comprising:

a body having a fluid inlet and a fluid outlet and configured to accelerate fluid flowing along a fluid flow path from the inlet to the outlet;

the fluid outlet being configured to provide a radially directed and substantially circumferentially continuous stream of fluid therefrom, further including a bypass device having a closed first configuration and an activated second configuration, in the first configuration the fluid flow path being closed; and in the second configuration the fluid flow path being open.

2. The tool of claim 1, wherein the fluid flow path is configured such that, in use, fluid enters the fluid inlet at a first speed and leaves the fluid outlet at a higher second speed.

3. The tool of claim 1, wherein the tool is configured to receive the supply of fluid from the surface location via a conduit.

4. The tool of claim 1, wherein the tool is configured for mounting on a tubular support member and for receiving the supply of fluid delivered from the surface location through the support member.

5. The tool of claim 1, wherein the fluid outlet comprises a flow restriction for accelerating fluid passing through the restriction.

6. The tool of claim 5, wherein the flow restriction is less than 5 mm wide, less than 4 mm wide, less than 3 mm wide, or less than 2 mm wide.

7. The tool of claim 6, wherein the flow restriction is around 1 mm wide.

8. The tool of claim 1, wherein the body comprises a plurality of radial flow passages extending through a body wall portion, wherein, in use, fluid is directed into the body through the fluid inlet and is directed through the radial flow passages and out of the tool through the fluid outlet.

9. The tool of claim 1, wherein the body comprises at least one lateral passage to facilitate flow of external fluid therethrough.

10. The tool of claim 9, said at least one lateral passage further comprising a plurality of lateral passages provided in the body.

11. The tool of claim 1, wherein an axial communication passage extends through the tool.

12. The tool of claim 1, wherein the bypass device is configured to be activated by an activating device delivered to the tool from surface.

13. The tool of claim 12, wherein, in the activated second configuration, the bypass device and the activating device cooperate to at least partially close an axial communication passage extending through the body, such that at least some of the fluid flowing from the fluid inlet is directed through the fluid outlet.

14. The tool of claim 1, in combination with a filter to filter fluid supplied to the tool.

15. The tool of claim 1, in combination with at least one stabiliser, to facilitate centralising and stabilising the tool in a wellbore.

16. The tool of claim 1, wherein the fluid outlet is located at a radial periphery of the body.

17. The tool of claim 1, wherein the fluid flow path is configured such that, in use, the fluid enters the fluid inlet in a first direction and leaves the fluid outlet in a different second direction.

18. The tool of claim 17, wherein the first direction is a predominantly axial direction, and the second direction is a predominantly radial direction.

19. The tool of claim 1, wherein the body is configured for mounting on a support member.

20. The tool of claim 1, wherein the body is configured to create a jet of the fluid for use in at least one of: cleaning tubing, treating tubing, eroding tubing, forming tubing, cutting tubing and severing tubing downhole.

21. The tool of claim 1, wherein the tool is configured for mounting on the distal end of a support member.

22. The tool of claim 1, wherein the body is combined with at least one of a tubing-cleaning brush, scraper or mill.

23. A method of cleaning or treating downhole tubing, the method comprising the steps of:

supplying a fluid to a downhole tool from a surface location; and directing a jet of the fluid from the tool at a wall of the downhole tubing;

wherein the jet of fluid is radially directed and circumferentially continuous, further including the step of producing the jet of fluid using a tool run into the tubing on a tubular support member.

24. The method of claim 23, further comprising the step of the jet of the fluid impinging on a circumferential area of an inner surface of downhole tubing.

25. The method of claim 23, further comprising the step of incorporating an abrasive material in the fluid.

26. The method of claim 23, further comprising the step of translating the jet of fluid axially along the wall of the tubing at a controlled rate.

27. The method of claim 26, further comprising the step of translating the jet of fluid up the wall of the tubing.

28. The method of claim 26, further comprising the step of translating the jet of fluid down the wall of the tubing.

29. The method of claim 23, further comprising the step of translating the tool through the tubing as the jet of fluid is directed at the tubing wall.

30. The method of claim 23, further comprising the step of supplying fluid to the tool from a tubing surface via a support member.

31. The method of claim 30, further comprising the step of supplying the fluid to the tool through the support member and then accelerating and redirecting the fluid as it passes through the tool.

32. The method of claim 23, further comprising the step of providing a path for downhole fluid to flow through the tool.

33. The method of claim 23, further comprising the step of providing a tool having a fluid outlet configured to produce the jet of fluid and mounting the tool on the distal end of a support member.

34. The method of claim 23, further comprising the step of filtering the fluid to be supplied to the tool.

35. The method of claim 23, further comprising the step of stabilizing the tool in the tubing.

36. The method of claim 23, further comprising the step of mechanically cleaning the wall of the downhole tubing and wherein directing the jet of the fluid at the wall of the downhole tubing follows the mechanical cleaning.

37. A downhole tool configured to receive a supply of fluid from a surface location, comprising:

a body having a fluid inlet and a fluid outlet and configured to accelerate fluid flowing along a fluid flow path from the inlet to the outlet;

wherein the tool body includes an inner body and an outer body, wherein the inner body includes the fluid inlet, and wherein the outer body includes the fluid outlet;

wherein the outer body defines a fluid outlet flow restriction such that when the fluid is directed through the outer body the fluid is formed into a fluid jet;

wherein the outer body includes two parts having opposing surfaces which define the fluid outlet; and the fluid outlet being configured to provide a radially directed and substantially circumferentially continuous stream of fluid therefrom.

38. The tool of claim 37, wherein one of the parts defines a larger diameter than the other part.

39. A method of cleaning or treating downhole tubing, the method comprising the steps of:

supplying a fluid to a downhole tool from a surface location; and directing a jet of the fluid from the tool at a wall of the downhole tubing to form a cut and then pulling a portion of tubing above the cut;

wherein the jet of fluid is radially directed and circumferentially continuous.

40. The method of claim 39, further comprising the step of retrieving the portion of the tubing.

41. The method of claim 39, further comprising the step of repetitively directing the jet of fluid at the tubing wall to form a second cut and then pulling a further portion of tubing above the second cut.

42. A method of cleaning or treating downhole tubing, the method comprising the steps of:

supplying a fluid to a downhole tool from a surface location;

directing a jet of the fluid from the tool at a wall of the downhole tubing;

providing the tool with a fluid flow path leading to a fluid outlet configured to produce the jet of fluid;

locating the tool downhole with the flow path closed, and opening the flow path; and wherein the jet of fluid is radially directed and circumferentially continuous.

43. The method of claim 42, comprising the step of opening the flow path by delivering an activating device to the tool from a surface of the tubing.

44. The method of claim 42, further comprising the step of providing an axial flow passage through the tool, and at least partially closing the passage when opening the fluid flow path.

45. A downhole tool configured to receive a supply of fluid from a surface location, comprising:

a body having a fluid inlet and a fluid outlet and configured to accelerate fluid flowing along a fluid flow path from the inlet to the outlet;

wherein the tool body includes an inner body and an outer body, wherein the inner body includes the fluid inlet, and wherein the outer body includes the fluid outlet;

wherein the outer body defines a fluid outlet flow restriction such that when the fluid is directed through the outer body the fluid is formed into a fluid jet;

wherein the outer body defines an outlet manifold configurable to distribute the fluid to the fluid outlet; and the fluid outlet being configured to provide a radially directed and substantially circumferentially continuous stream of fluid therefrom.

46. A downhole tool configured to receive a supply of fluid from a surface location, comprising:

a body having a fluid inlet and a fluid outlet and configured to accelerate fluid flowing along a fluid flow path from the inlet to the outlet;

wherein the body is configured for mounting between upper and lower portions of a support member; and the fluid outlet being configured to provide a radially directed and substantially circumferentially continuous stream of fluid therefrom.

47. A downhole tool configured to receive a supply of fluid from a surface location, comprising:

a body having a fluid inlet and a fluid outlet and configured to accelerate fluid flowing along a fluid flow path from the inlet to the outlet;

wherein the body is combined with any of gripping or lifting tools for retrieving a section of downhole tubing that has been cut using the tool;

said body further including an elongate support member incorporating said tools; and the fluid outlet being configured to provide a radially directed and substantially circumferentially continuous stream of fluid therefrom.

48. A method of cleaning or treating downhole tubing, the method comprising the steps of:

supplying a fluid to a downhole tool from a surface location;

directing a jet of the fluid from the tool at a wall of the downhole tubing; and providing the tool with a fluid outlet configured to produce the jet of fluid, the fluid outlet having a first diameter and the downhole tubing having a second diameter, and the second diameter being: no more than 5 cm larger than the first diameter; no more than 4 cm larger than the first diameter; no more than 3 cm larger than the first diameter; no more than 2 cm larger than the first diameter; no more than 1 cm larger than the first diameter, or no more than 0.5 cm larger than the first diameter;

wherein the jet of fluid is radially directed and circumferentially continuous.

49. A method of cleaning or treating downhole tubing, the method comprising the steps of:

supplying a fluid to a downhole tool from a surface location;

directing a jet of the fluid from the tool at a wall of the downhole tubing; and providing the tool with a fluid outlet configured to produce the jet of fluid, the fluid outlet having a first diameter and the downhole tubing having a second diameter, wherein the second diameter is around 0.5 cm larger than the first diameter;

wherein the jet of fluid is radially directed and circumferentially continuous.

50. A method of cleaning or treating downhole tubing, the method comprising the steps of:

supplying a fluid to a downhole tool from a surface location;

directing a jet of the fluid from the tool at a wall of the downhole tubing;

providing the tool with a fluid outlet configured to produce the jet of fluid and mounting the tool between upper and lower portions of a support member; and wherein the jet of fluid is radially directed and circumferentially continuous.

51. A method of cleaning or treating downhole tubing, the method comprising the steps of:

supplying a fluid to a downhole tool from a surface location;

directing a jet of the fluid from the tool at a wall of the downhole tubing;

translating the jet of fluid along a length of the downhole tubing and eroding and removing a section of casing; and wherein the jet of fluid is radially directed and circumferentially continuous.

* * * * *